US008318397B2

(12) United States Patent
Cheong et al.

(10) Patent No.: US 8,318,397 B2
(45) Date of Patent: Nov. 27, 2012

(54) ELECTROPHOTOGRAPHIC TONER AND METHOD OF PREPARING THE SAME

(75) Inventors: Min-Young Cheong, Seoul (KR); Jun-Young Lee, Seoul (KR); Kyeong Pang, Suwon-si (KR); Soon-Cheol Jeong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 516 days.

(21) Appl. No.: 12/561,530

(22) Filed: Sep. 17, 2009

(65) Prior Publication Data

US 2010/0067956 A1 Mar. 18, 2010

(30) Foreign Application Priority Data

Sep. 17, 2008 (KR) ..... 10-2008-0091191
Sep. 17, 2009 (KR) ..... 10-2009-0088105

(51) Int. Cl.
*G03G 9/00* (2006.01)

(52) U.S. Cl. ..... 430/108.3; 430/108.1; 430/108.7; 430/108.8; 430/137.11

(58) Field of Classification Search ..... 430/108.1, 430/108.3, 108.4, 108.7, 108.8, 137.11
See application file for complete search history.

(56) References Cited

U.S. PATENT DOCUMENTS

2008/0166649 A1* 7/2008 Moffat et al. ..... 430/108.8
2009/0111038 A1* 4/2009 Shin et al. ..... 430/48
2010/0009283 A1* 1/2010 Pang et al. ..... 430/124.1

* cited by examiner

*Primary Examiner* — Mark F Huff
*Assistant Examiner* — Stewart Fraser
(74) *Attorney, Agent, or Firm* — Stanzione & Kim, LLP

(57) ABSTRACT

An electrophotographic toner and a method of preparing the same are provided. The electrophotographic toner includes a latex, a colorant, and a releasing agent, wherein the electrophotographic toner includes silicon (Si) and iron (Fe), each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases in a heat absorption curve of the toner measured by a differential scanning calorimeter (DSC) is in the range of about 68 to about 89° C., and a peak temperature of the maximum heat absorption peak curve is in the range of about 86 to about 89° C.

16 Claims, 3 Drawing Sheets

ELECTROPHOTOGRAPHIC TONER AND METHOD OF PREPARING THE SAME

CROSS-REFERENCE TO RELATED PATENT APPLICATION

This application claims the benefit of Korean Patent Application No. 10-2008-0091191, filed on Sep. 17, 2008, and Korean Patent Application No. 10-2009-0088105, filed on Sep. 17, 2009, in the Korean Intellectual Property Office, the disclosure of which is incorporated herein in its entirety by reference.

TECHNICAL FIELD

The present general inventive concept relates to an electrophotographic toner and a method of preparing the same.

BACKGROUND OF RELATED ART

In an electrophotographic process or electrostatic recording process, a developer used to visualize an electrostatic image or an electrostatic latent image may include a two-component developer formed of toner and carrier particles and an one-component developer only including toner. The one-component developer may be classified into a magnetic one-component developer and a nonmagnetic one-component developer. A separate fluidizing agent such as colloidal silica is often added to the nonmagnetic one-component developer in order to increase the fluidity of the toner. In general, toner includes coloring particles obtained by dispersing a colorant such as carbon black or other additives in latex and particulating the latex.

Methods of preparing toner include pulverization and polymerization. In pulverization, toner is obtained by melting and mixing synthetic resins, pigments and, if required, other additives, pulverizing the mixture, and sorting the particles until particles having desired size are obtained. In polymerization, a polymerizable monomer composition is manufactured by uniformly dissolving or dispersing various additives such as a pigment, a polymerization initiator and, if required, a cross-linking agent and an antistatic agent in a polymerizable monomer. Then, the polymerizable monomer composition is dispersed in an aqueous dispersive medium containing a dispersion stabilizer by using an agitator so as to form minute liquid droplet particles of the polymerizable monomer composition. Subsequently, the temperature is increased and suspension polymerization is performed to obtain polymerized toner having coloring polymer particles with a desired size.

In an imaging apparatus such as an electrophotographic device or an electrostatic recording device, an electrostatic latent image is formed by exposing the image on a uniformly charged photoreceptor, a toner image is formed by attaching toner to the electrostatic latent image, the toner image is transferred onto a transfer medium such as transfer paper or the like; and a non-fixed toner image is fixed onto the transfer medium by using various methods, including heating, pressurizing, solvent steaming and the like. In most fixing processes, the transfer medium to which the toner image is transferred passes through fixing rollers and pressing rollers and the toner is heated and pressed so as to be fused to the transfer medium.

In images formed by an imaging apparatus such as electrophotocopier, high precision and accuracy need to be improved. In general, toner used in an imaging apparatus is usually obtained by pulverization. In pulverization, color particles having a large range of size distribution may be easily formed. Thus, in order to obtain satisfactory developing properties, there is a need to sort the coloring particles obtained through pulverization according to a size so as to reduce the particle size distribution. However, it is difficult to precisely control the particle size and the particle size distribution by using a general mixing/pulverizing process in the manufacture of toner suitable for an electrophotographic process or an electrostatic recording process. Also, when preparing a fine particle toner, the toner preparation yield is adversely affected by the sorting process. In addition, there are limits in changing/adjusting of a toner design for obtaining desirable charging and fixing properties. Accordingly, polymerized toner in which the size of particles is easily controlled and a complex manufacturing process such as sorting is not needed, have been recently highlighted.

When toner is prepared by the polymerization, polymerized toner having a desired particle size and particle size distribution may be obtained without pulverizing or sorting. However, even if the polymerization is used, agglomeration of latex and a colorant may be inefficient and aluminum-based substances used to form an agglomerating agent may be harmful to both environment and human body.

Also, in order for high gloss of toner and wide fixing regions to be compatible, a capsule-formed toner structure may be used and controlled through an agglomeration process control so as to suppress surface exposure of a colorant and releasing agent and to distribute to charging uniformity, flowability, and thermal storage characteristics. However, if a large amount of releasing amount having a low melting point and low viscosity is contained to improve gloss of a gloss paper, a low molecular part and resin may be compatible to some degree and may be plasticized so that there are problems in thermal storage characteristics and flowability of toner.

SUMMARY OF DISCLOSURE

According to an aspect of the present general inventive concept, there is provided an electrophotographic toner including a latex, a colorant, and a releasing agent, wherein the electrophotographic toner includes silicon (Si) and iron (Fe), each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases in a heat absorption curve of the toner measured by a differential scanning calorimeter (DSC) is in the range of about 68 to about 89° C., and a peak temperature of the maximum heat absorption peak curve is in the range of about 86 to about 89° C.

A difference between Tg of the latex and Tg of the toner may be in the range of about 6.4 to about 12.0° C.

The releasing agent may include an ester group.

The releasing agent may include a mixture of a paraffin-based wax and an ester-based wax; or an ester group-containing paraffin-based wax.

The releasing agent may include 100 parts by weight of a paraffin-based wax and about 12.5 to about 50 parts by weight of an ester-based wax.

An volume average particle diameter of the electrophotographic toner may be in the range of about 3 to about 8 μm.

An average circularity of the electrophotographic toner may be in the range of about 0.940 to about 0.980.

An average circularity difference of the toner in which an average particle diameter is in the range of about 2 to 5 μm, may be about 0.020 or below.

A volume average particle size distribution index (GSDv) of the electrophotographic toner and a number average particle size distribution index (GSDp) of the electrophotographic toner may be about 1.25 or less.

According to another aspect of the present general inventive concept, there is provided a method of preparing an electrophotographic toner including: preparing a mixture solution of a primary latex, a colorant dispersion, and a release agent dispersion; preparing a primary agglomerated toner by adding an agglomerating agent to the mixture solution; and preparing a secondary agglomerated toner by coating the primary agglomerated toner with a secondary latex prepared by polymerizing at least one polymerizable monomer, wherein the electrophotographic toner comprises Si and Fe, each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases in a heat absorption curve of the toner measured by a differential scanning calorimeter (DSC) is in the range of about 68 to about 89° C., and a peak temperature of the maximum heat absorption peak curve is in the range of about 86 to about 89° C.

The primary latex may include: polyester; a polymer obtained by polymerizing at least one polymerizable monomer; or a mixture thereof.

The method may further include coating a tertiary latex prepared by polymerizing at least one polymerizable monomer on the secondary agglomerated toner.

The at least one polymerizable monomer may include: at least one selected from the group consisting of styrene-based monomers; acrylic acids; methacrylic acid; derivatives of (meth)acrylic acids; ethylenically unsaturated mono-olefines; halogenated vinyls; vinyl esters, vinyl ethers; vinyl ketones; and nitrogen-containing vinyl compounds.

The releasing agent dispersion may include: a mixture of a paraffin-based releasing wax and an ester-based wax; or an ester group-containing paraffin-based wax.

The agglomerating agent may include a Si and Fe-containing metal salt.

The agglomerating agent may include polysilicate iron.

According to another aspect of the present general inventive concept, there is provided a toner supplying unit including: a toner tank storing toner; a supplying part projecting inside the toner tank to discharge the toner from the toner tank; and a toner agitating member rotatably disposed inside the toner tank to agitate the toner in almost an entire inner space of the toner tank, wherein the toner includes silicon (Si) and iron (Fe), each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases in a heat absorption curve of the toner measured by a differential scanning calorimeter (DSC) is in the range of about 68 to about 89° C., and a peak temperature of the maximum heat absorption peak curve is in the range of about 86 to about 89° C.

According to another aspect of the present general inventive concept, there is provided an imaging apparatus including: an image carrier; an image forming unit that forms an electrostatic latent image on a surface of the image carrier; a unit receiving a toner, a toner supplying unit that supplies the toner onto the surface of the image carrier to develop the electrostatic latent image on the surface of the image carrier into a toner image; and a toner transferring unit that transfers the toner image to a transfer medium from the surface of the image carrier, wherein the toner includes silicon (Si) and iron (Fe), each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases in a heat absorption curve of the toner measured by a differential scanning calorimeter (DSC) is in the range of about 68 to about 89° C., and a peak temperature of the maximum heat absorption peak curve is in the range of about 86 to about 89° C.

According to the present general inventive concept, a releasing agent, which is harmless to a human body and an environment and in which compatibility with latex of toner is differentiated, is used to prepare the electrophotographic toner having a high gloss image and a wide fixing region.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF SEVERAL EMBODIMENTS

The present general inventive concept will now be described more fully with reference to the accompanying drawings, in which exemplary embodiments of the present general inventive concept are shown.

Electrophotographic toner according to the present general inventive concept includes latex, a colorant, and a releasing agent and further includes silicon (Si) and iron (Fe) in the range of about 3 to about 1,000 ppm. A mole ratio of Si to Fe (Si/Fe) is in the range of about 0.2 to about 0.8. Also, in a heat absorption curve of the toner measured by a differential scanning calorimeter (DSC), an initiation temperature of a maximum heat absorption peak curve when a temperature increases is in the range of about 68 to about 89° C. and a peak temperature of the maximum heat absorption peak curve is in the range of about 86 to about 89° C.

From an analysis of the DSC heat absorption curve of the toner obtained by using the DSC, behavior between heat and the toner, that is, heat transferring in the toner and a change of state in the toner, may be identified.

In particular, from the DSC heat absorption curve when a temperature increases, a change of state in the toner when heat is applied to the toner, transferring of a releasing agent component, and the heat absorption peak accompanying with melting and dissolving may be observed.

In the measurement using the DSC according to an embodiment of the present general inventive concept, heat exchange in the toner and the behavior of the toner are observed so that a highly precise and heat-resisting input compensated DSC needs to be used based on a measurement principle. For example, DSC-7 (name of a product) manufactured by PerkinElmer Inc. may be used. In this case, about 10 to about 15 mg of toner sample or about 2 to about 5 mg of releasing agent sample may be used.

Figure 1:
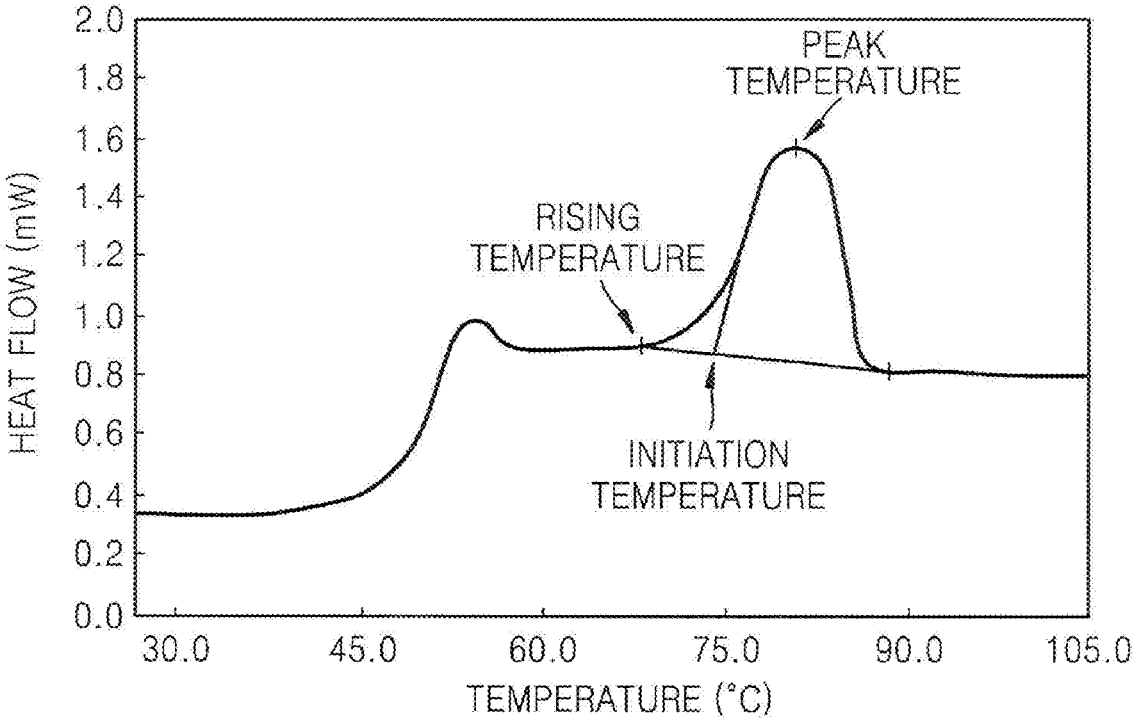
FIG. 1 is a graph illustrating heat absorption measured by using a differential scanning calorimeter (DSC)

The measurement may be performed according to ASTM D3418-82. Before taking the DSC curve, a temperature of the sample (toner or releasing agent) increases once and thus thermal history of the sample is removed. Then, the DSC curve is obtained by cooling (temperature decrease) and heating (temperature increase) at a temperature of 10 to 200° C. at a speed of about 10° C./min. A temperature in the DSC heat absorption curve according to an embodiment of the present general inventive concept is defined as follows with reference to FIG. 1.

A rising temperature denotes a temperature when a peak curve is clearly separated from a base line, that is, a temperature when a derivative of the peak curve starts increasing from a positive value or a temperature when a derivative of the peak curve starts changing from a negative to a positive.

The initiation temperature is a temperature at an intersection point of a line in a contact direction from a point at which the derivative of the peak curve is maximized, and a base line.

The peak temperature is the maximum temperature in the peak curve.

In the DSC heat absorption curve of the toner measured by the DSC according to an embodiment of the present general inventive concept, the initiation temperature of the maximum heat absorption peak curve when a temperature increases is, for example, in the range of about 68 to about 89° C.

If the initiation temperature is in the above range, a preservation property and flowability of the toner with respect to heat, and fixability of the toner may be improved.

In addition, in the toner according to an embodiment of the present general inventive concept, the peak temperature of the maximum hear absorption peak curve is, for example, in the range of about 86 to about 89° C. If the peak temperature is in the above range, a preservation property and flowability of the toner with respect to heat, and fixability of the toner may be improved.

In addition, the rising temperature of the maximum heat absorption peak curve is in the range of about 68 to about 89° C., for example, about 82 to about 89° C. If the rising temperature is in the above range, a plasticity change is prevented from occurring at a low temperature for a long time and a melting temperature of wax does not rise during fixing so that fixing at a low temperature is easy.

The electrophotographic toner includes Si and Fe. The amount of Si and Fe is in the range of about 3 to about 1,000 ppm. If the amount of Si and Fe is in the above range, the toner may have improved charging characteristics and the contamination of the inside of a printer used may be prevented.

A mole ratio of Si to Fe (Si/Fe) may be in the range of about 0.1 to about 5, for example, about 0.15 to about 3. If the mole ratio is in the above range, an agglomerating force during the preparation of the toner and charging characteristics of the toner may be improved.

A method of preparing an electrophotographic toner, according to an embodiment of the present general inventive concept includes: preparing a mixture solution by mixing a primary latex, a colorant dispersion, and a releasing agent dispersion; preparing a primary agglomerated toner by adding an agglomerating agent to the mixture solution; and preparing a secondary agglomerated toner by coating the primary agglomerated toner with a secondary latex prepared by polymerizing at least one polymerizable monomer, wherein the toner includes Si and Fe, each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases is in the range of about 68 to about 89° C. in a heat absorption curve of the toner measured by the DSC, and a peak temperature of the maximum heat absorption peak curve is in the range of about 86 to about 89° C.

Examples of the agglomerating agent may include NaCl, $MgCl_2$, $MgCl_2.8H_20$, $[Al_2(OH)_nCl_{6-n}]_m$ ($1 \leqq n \leqq 5$, $1 \leqq m \leqq 10$), $(Al_2(SO_4)_3.18H_2O$, polyaluminum chloride (PAC), polyaluminum sulfate (PAS), polyaluminum silicate sulfate (PASS), ferrous sulfate, ferric sulfate, ferric chloride, calcium hydroxide, calcium carbonate, Si and Fe-containing metal salts, and mixtures thereof. However, the agglomerating agent is not limited to these examples.

The amount of the agglomerating agent may be, for example, in the range of about 0.1 to about 10 parts by weight, about 0.5 to about 8 parts by weight, or about 1 to about 6 parts by weight, based on 100 parts by weight of the primary latex. If the amount of the agglomerating agent is in the above range, agglomeration efficiency may increase, and charging properties of the toner and the particle size distribution may be improved.

In the method of preparing the electrophotographic toner according to an embodiment of the present general inventive concept, the agglomerating agent may be a Si and Fe-containing metal salt. In the toner prepared using the Si and Fe-containing metal salt as a agglomerating agent, the amount of Si and Fe may be in the range of about 3 to about 1,000 ppm, for example, about 0.15 to about 3 ppm. If the amount of Si and Fe is in the above range, the toner may have improved charging characteristics, and the contamination of the inside of a printer used may be prevented.

The Si and Fe-containing metal salt may include, for example, polysilicate iron. In particular, due to increased ionic strength by adding the Si and Fe-containing metal salt during the preparation of the toner and interparticular collisions, the size of the primary agglomerated toner is increased. The Si and Fe-containing metal salt may be poly silica iron. Examples of the Si and Fe-containing metal may include model Nos. of PSI-025, PSI-050, PSI-085, PSI-100, PSI-200, and PSI-300 (manufactured by Suido Kiko Co.). Physical properties and compositions of PSI-025, PSI-050, PSI-085, PSI-100, PSI-200, and PSI-300 are illustrated in Table 1 below.

TABLE 1

| | | Type | | | | | |
|---|---|---|---|---|---|---|---|
| | | PSI-025 | PSI-050 | PSI-085 | PSI-100 | PSI-200 | PSI-300 |
| Si/Fe mole ratio | | 0.25 | 0.5 | 0.85 | 1 | 2 | 3 |
| Main component (concentration) | Fe (wt %) | 5.0 | 3.5 | 2.5 | 2.0 | 1.0 | 0.7 |
| | SiO2 (wt %) | 1.4 | 1.9 | 2.0 | | 2.2 | |
| pH(1 w/v %) | | 2-3 | | | | | |
| Specific gravity(20° C.) | | 1.14 | 1.13 | 1.09 | 1.08 | 1.06 | 1.04 |
| Viscosity(mPa · S) | | 2.0 or greater | | | | | |
| Average molecular weight (Dalton) | | 500,000 | | | | | |
| Appearance | | transparent, yellowish brown liquid | | | | | |

Since the Si and Fe-containing metal salt is used as an agglomerating agent during the preparation of the electrophotographic toner, the particle size may be reduced and the particle shape may also be controlled The agglomerating agent may be added at a pH of, for example, about 0.1 to about 2.0, a pH of about 0.3 to about 1.8, or a pH of about 0.5 to about 1.6. If a pH is in the above range when the agglomerating agent is added, handling efficiency may be increased. Also, an unpleasant odor of a chain transfer agent, that is, a sulfur-containing compound, used in the preparation of latex is improved by Fe added to the agglomerating agent and thus agglomeration efficiency may be improved.

A volume average particle diameter of the electrophotographic toner according to an embodiment of the present general inventive concept may be, for example, about 3 to about 8 μm, about 4 to about 7.5 μm, or about 4.5 to about 7 μm, and average circularity of the toner may be, for example, about 0.940 to about 0.980 or about 0.960 to about 0.975.

In general, the smaller the toner particle size, the higher the resolution and definition of an image. However, when a transfer speed and a cleansing force are taken into consideration, small toner particles are not appropriate. Thus, it is important to have an appropriate toner particle size.

The volume average particle diameter of the toner may be measured by electrical impedance analysis.

If the volume average particle diameter of the toner is in the range of about 3 to about 8 μm, clean of a photoreceptor is easy, mass-production yield is improved, a problem on harmfulness to the human body due to caused due to scattering may be solved, high resolution and high image quality may be obtained, the toner may be uniformly charged, fixing characteristics of the toner may be improved, and it is easy for a doctor blade to control a toner layer.

If the average circularity of the toner is in the range of about 0.940 to about 0.980, an image developed on a transfer medium may be prevented from having a great height and an increase of toner consumption may be prevented. Also, a phenomenon in which voids between toner particles are too large and thus the image developed on the transfer medium may have an insufficient coverage ratio may be prevented. Thus, an excessive amount of toner is not needed to obtain a desired image concentration so that toner consumption may be reduced. In addition, a phenomenon in which an excessive amount of toner is supplied onto a development sleeve and thus the sleeve is non-uniformly coated with the toner is prevented.

The circularity of the toner may be measured by a flow particle image analyzer (FPIA)-3000 produced by SYSMEX Co., Inc., using the following Equation:

$$\text{Circularity}=2\times(\pi\times\text{area})^{0.5}/\text{circumference}$$

The circularity may be in the range of 0 to 1, and as the circularity approaches 1, the toner particle shape becomes more circular.

In particular, an average circularity difference of the toner in which an volume average particle diameter is in the range of about 2 to 5 μm is, for example, about 0.020 or below. If the average circularity difference is 0.020 or below, uniformity of the particles is improved and a cleaning problem in an imaging apparatus may be solved so that contamination may be prevented.

A toner particle distribution coefficient may be a volume average particle size distribution index (GSDv) or a number average particle size distribution index (GSDp), which may be measured as follows.

First, a toner particle diameter distribution is obtained from toner particle diameters measured using a Multisizer III (manufactured by Beckman Coulter Inc.). The toner particle diameter distribution is divided into predetermined particle diameter ranges (channels). With respect to the respective particle diameter ranges (channels), the volume cumulative distribution of toner particles and the number cumulative distribution of toner particles are measured, wherein, in each of the volume and the number cumulative distributions, the particle size in each distribution is increased in a direction from the left to the right. A cumulative particle diameter at 16% of the respective cumulative distributions is defined as a volume average particle diameter D16v and a number average particle diameter D16p. Likewise, a cumulative particle diameter at 50% of the respective cumulative distributions is defined as a volume average particle diameter D50v and a number average particle diameter D50p. Similarly, a cumulative particle diameter at 84% of the respective cumulative distributions is defined as a volume average particle diameter D84v and a number average particle diameter D84p.

In this regard, the GSDv and the GSDp may be obtained using the relations that the GSDv is defined as $(D84v/D16v)^{0.5}$, and the GSDp is defined as $(D84p/D16p)^{0.5}$.

The GSDv and GSDp is each, for example, about 1.25 or less. If each of GSDv and GSDp is about 1.25 or less, particle diameters may be uniform.

In the method of preparing a toner, the primary latex may be polyester, a polymer obtained by polymerizing at least one polymerizable monomer, or a mixture thereof (a hybrid type). When the primary latex is a polymer, the polymer may be polymerized with a releasing agent such as wax in the polymerization process or the polymer may be mixed with the releasing agent.

The polymerization process may be an emulsion polymerization distribution process. As a result of the emulsion polymerization distribution process, the primary latex particles may have a particle size of about 1 μm or less, for example, in the range of about 100 to about 300 nm or in the range of about 150 to about 250 nm.

The polymerizable monomer used herein may include at least one selected from the group consisting of styrene-based monomers such as styrene, vinyltoluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, or methacrylamide; ethylenically unsaturated monoolefines such as ethylene, propylene, or butylene; halogenated vinyls such as vinyl chloride, vinylidene chloride, or vinyl fluoride; vinyl esters such as vinyl acetate or vinyl propionate; vinyl ethers such as vinylmethylether or vinylethylether; vinyl ketones such as vinylmethylketone or methylisoprophenylketone; and a nitrogen-containing vinyl compound such as 2-vinylpyridine, 4-vinylpyridine, or N-vinylpyrrolidone.

When the primary latex particle is prepared, a polymerization initiator and a chain transfer agent may be further used to efficiently perform the polymerization process.

Examples of the polymerization initiator may include persulfates such as potassium persulfate or ammonium persulfate; azo compounds such as 4,4-azobis(4-cyano valeric acid), dimethyl-2,2'-azobis(2-methylpropionate), 2,2-azobis (2-amidinopropane)dihydrochloride, 2,2-azobis-2-methyl-N-1,1-bis(hydroxymethyl)-2-hydroxyethylpropioamide, 2,2'-azobis(2,4-dimethylvaleronirile), 2,2'-azobisisobutyronirile, or 1,1'-azobis(1-cyclohexancarbonirile); and peroxides such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, or di-t-butylperoxyisophthalate. In addition, oxidation-reduction initiators prepared by combining these polymerization initiators and reduction agents may also be used as the polymerization initiator.

The chain transfer agent refers to a material that changes the type of a chain carrier when a chain reaction occurs. The chain transfer agent includes a material that induces new chain activity to be substantially weaker than the existing chain activity. Due to the chain transfer agent, the degree of polymerization of polymerizable monomers may be reduced, and a novel chain may be initiated. Due to the chain transfer agent, molecular weight distributions of the toner may be controlled.

The amount of the chain transfer agent may be, for example, in the range of about 0.1 to about 5 parts by weight, about 0.2 to about 3 parts by weight, or about 0.5 to about 2.0 parts by weight, based on 100 parts by weight of the at least one polymerizable monomer. If the amount of the change transfer agent is in the above range, the molecular weight of the toner may be appropriately controlled and thus the toner may have improved agglomeration efficiency and fixing characteristics.

Examples of the chain transfer agent may include, but are not limited to, sulfur-containing compounds such as dodecanethiol, thioglycolic acid, thioacetic acid, or mercaptoethanol; phosphorous acid compounds such as a phosphorous acid or sodium phosphorous acid; hypophosphorous acid compounds such as a hypophosphorous acid or a sodium hypophosphorous acid; and alcohols such as methylalcohols, ethylalcohols, isopropylalcohols, or n-butylalcohols.

The primary latex may further include a charge control agent. The charge control agent may be a negative charge control agent or a positive charge control agent. Examples of the negative charge control agent may include an organic metal complex or a chelate compound such as an azo complex containing chromium or a mono azo metal complex; a salicylic acid compound containing metal such as chromium, iron and zinc; and an organic metal complex of an aromatic hydroxycarboxylic acid and an aromatic dicarboxylic acid, and any known negative charge control agent may be used without limitation. In addition, examples of the positive charge control agent may include a modified product such as nigrosine and a fatty acid metal salt thereof and an onium salt including a quaternary ammonium salt such as tributylammonium 1-hydroxy-4-naphthosulfonate and tetrabutylammonium tetrafluoro borate which may be used alone or in combination of at least two. The charge control agent stably supports the toner on a development roller with an electrostatic force. Thus, by using the charge control agent, stable and high-speed charging may be ensured.

The primary latex obtained as described above may be mixed with the colorant dispersion and the releasing agent dispersion to prepare a mixture solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare the colorant dispersion, the black colorant may be carbon black or aniline black. For color toner, at least one colorant selected from the group consisting of the cyan colorant, the magenta colorant, and the yellow colorant may be further used in addition to the black colorant.

The yellow colorant may be a condensation nitrogen compound, an isoindolinone compound, an anthraquine compound, an azo metal complex, or an allyl imide compound. Specifically, examples of the yellow colorant include C.I. pigment yellows 12, 13, 14, 17, 62, 74, 83, 93, 94, 95, 109, 110, 111, 128, 129, 147, 168, and 180.

Examples of the magenta colorant may include condensation nitrogen compounds, anthraquine compounds, quinacridone compounds, base dye rate compounds, naphthol compounds, benzo imidazole compounds, thioindigo compounds, and perylene compounds. Specifically, examples of the magenta colorant include C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

Examples of the cyan colorant may include copper phthalocyane compounds and derivatives thereof, anthraquine compounds, and base dye rate compounds. Specifically, examples of the cyan colorant include C.I. pigment blues 1, 7, 15, 15:1, 15:2, 15:3, 15:4, 60, 62, and 66.

These colorants may be used alone or in combination, and may be selected in consideration of color, chroma, brightness, weather resistance, or dispersibility in toner.

The amount of the colorant used to prepare the colorant dispersion may be, for example, in the range of about 0.5 to about 15 parts by weight, about 1 to about 12 parts by weight, or about 2 to about 10 parts by weight, based on 100 parts by weight of the toner. If the amount of the colorant used to prepare the colorant dispersion is in the above range, coloring effect may be obtained, an increase of a manufacturing cost of the toner may be prevented, and sufficient electrification quantity may be obtained.

The emulsifier used to prepare the colorant dispersion may be any emulsifier that is known in the art. For example, the emulsifier may be an anionic reactive emulsifier, a non-ionic reactive emulsifier, or a mixture thereof. The anionic reactive emulsifier may be HS-10 (manufactured by Dai-ich kogyo Inc.) or Dawfax 2-A1 (manufactured by Rhodia Inc.). The non-ionic reactive emulsifier may be RN-10 (manufactured by Dai-ichi kogyo).

The releasing agent dispersion used in the method of preparing the electrophotographic toner may include a releasing agent, water, or an emulsifier.

The releasing agent enables toner to be fixed to a final image receptor at a low fixing temperature and to have excellent final image durability and resistance to abrasion. Thus, characteristics of toner are very dependent on the type and amount of the releasing agent.

In particular, a difference δTg between Tg of the latex before the releasing agent is added and Tg of the toner including the releasing agent indicates compatibility of the latex and the toner. As the compatibility of the releasing agent and the latex reduces, a temperature difference reduces. As the compatibility of the releasing agent and the latex reduces, a distribution size of the releasing agent in the toner may increase.

In the electrophotographic toner, the difference δTg between Tg of the latex and Tg of the toner may be, for example, in the range of about 6.4 to about 12.0° C.

If the difference δTg is in the above range, the compatibility of the releasing agent and the latex is prevented from excessively increasing so that there is a low possibility that the releasing agent is projected from the surface of the toner, the toner may have sufficient durability when mechanical stress occurs and a temperature increases, a fixing regions increase, and a high temperature preservation property and flowability may be improved.

In the releasing agent which may be used in the present general inventive concept, the initiation temperature of the maximum heat absorption peak curve when a temperature increases in the DSC heat absorption curve is in the range of about 68 to about 75° C., the peak temperature of the maximum heat absorption peak curve is in the range of about 77 to about 85° C., and the difference δTg between Tg of the latex and Tg of the toner may be in the range of about 6.4 to about 12.0° C. However, the releasing agent is not limited thereto.

An available releasing agent may be, but are not limited to, polyethylene-based wax, polypropylene-based wax, silicon wax, paraffin-based wax, ester based wax, carnauba wax, or metallocene wax. The melting point of the releasing agent may be, for example, in the range of about 50 to about 150° C. The releasing agent may be physically attached to toner particles, but does not covalently bind to toner particles. Such a releasing agent enables toner to be fixed to a final image receptor at a low fixing temperature and to have excellent final image durability and abrasion-resistance characteristics.

The amount of the releasing agent may be in the range of about 1 to about 20 parts by weight, about 2 to about 16 parts by weight, or about 3 to about 12 parts by weight, based on 100 parts by weight of the toner. If the amount of the releasing agent is in the above range, low-temperature fixing performance may be improved, a fixing temperature range may be sufficiently large, and preservation characteristics and the manufacturing costs may be increased.

The releasing agent may be an ester group-containing wax. Examples of the ester group-containing wax may include (1) a mixture of an ester-based wax and a non-ester based wax; and (2) an ester group-containing wax prepared by adding an ester group to a non-ester based wax.

Since an ester group has high affinity with respect to the latex component of the electrophotographic toner, the wax may be uniformly distributed among toner particles and thus may effectively function. Meanwhile, the non-ester based wax has a releasing effect on the latex, and thus may suppress excessive plasticizing reactions, which occur when an ester-based wax is exclusively used. Therefore, the toner may retain satisfactory development characteristics for a long period of time.

Examples of the ester-based wax may include esters of C15-C30 fatty acids and monovalent to quinquevalent alcohols, such as behenic acid behenyl, stearic acid stearyl, stearic acid ester of pentaeritritol, or montanic acid glyceride. Also, if an alcohol component that forms ester is a monovalent alcohol, the number of carbon atoms may be in the range of about 10 to about 30, and if the alcohol component that forms ester is a polymeric alcohol, the number of carbon atoms may be in the range of about 3 to about 10.

The non-ester based wax may be polyethylene-based wax or paraffin-based wax.

Examples of the ester group-containing wax may include: a mixture of a paraffin-based wax and an ester-based wax; and an ester group-containing paraffin-based wax. Examples of the ester group-containing wax may also include P-280, P-318, and P-319 (manufactured by Chukyo yushi Co., Ltd).

If the releasing agent is a mixture of a paraffin-based wax and an ester based wax, the releasing agent may include, for example, 100 parts by weight of a paraffin-based wax and about 12.5 to about 50 parts by weight of a ester-based wax.

If the amount of the ester-based wax and the paraffin-based wax is in the above range, compatibility of the ester-based wax and the paraffin-based wax with respect to the primary latex may be improved, plasticizing characteristics of the toner are appropriately controlled and the toner retains development characteristics for a long period of time.

Like the emulsifier used in the colorant dispersion, any emulsifier that is used in the art may be used as an emulsifier for the releasing agent. Examples of the emulsifier available for the releasing agent dispersion may include an anionic reactive emulsifier, a non-ionic reactive emulsifier, and mixtures thereof. The anionic reactive emulsifier may be HS-10 (manufactured by Dai-ich kogyo Inc.) or Dawfax 2-A1 (manufactured by Rhodia Inc.). The non-ionic reactive emulsifier may be RN-10 (manufactured by Dai-ichi kogyo).

Due to the method described above, a molecular weight, Tg, and rheological characteristics of the primary latex prepared may be controlled to be fixed at a low fixing temperature.

The prepared primary latex, the colorant dispersion, and the releasing agent dispersion are mixed to obtain a mixture solution, and then an agglomerating agent is added to the mixture solution, thereby preparing a agglomerated toner. More specifically, the primary latex, the colorant dispersion, and the releasing agent dispersion are mixed and then the agglomerating agent is added thereto at a pH in the range of about 0.1 to about 2.0, thereby preparing a primary agglomerated toner having a particle size of 2.5 μm or less. The primary agglomerated toner may act as a core. Then, a secondary latex is added thereto and then a pH of the system used is controlled to be in the range of about 6 to about 8. Then, when a particle size of the resultant is maintained constant for a predetermined time period, the temperature is increased to 90 to 98° C. and the pH is decreased to 5 to 6, thereby preparing a secondary agglomerated.

The secondary latex may be obtained by polymerizing the at least one polymerizable monomer as described above. The polymerization process may be an emulsion polymerization distribution process. As a result of the emulsion polymerization distribution process, the secondary latex particles may have a particle size of about 1 μm or less, for example, in the range of about 100 to about 300 nm. The secondary latex may also include wax, and the wax may be included in the secondary latex in the polymerization process.

Meanwhile, a tertiary latex prepared by polymerizing the at least one polymerizable monomer described above may be further coated on the secondary agglomerated toner.

By forming the shell layer using the secondary latex or tertiary latex, the toner obtains high durability and excellent preservation characteristics during shipping and handling. In this case, a polymerization inhibitor may be further added to prevent formation of new latex particles, and starved-feeding conditions may be used to appropriately coat a monomer mixture solution on the toner.

The obtained secondary agglomerated toner or tertiary agglomerated toner is filtered to separate toner particles, and the toner particles are dried. Then, an external additive is added to the dried toner particles, and the amount of charge applied is controlled, thereby obtaining a final dry toner.

The external additive may include silica or $TiO_2$. The amount of the external additive may be, for example, in the range of about 1.5 to about 7 parts by weight or about 2 to about 5 parts by weight based on 100 parts by weight of toner to which the external additive is not added. When the amount of the external additive is in the above range, a caking, a phenomenon in which toner particles may be attached to each other due to a agglomerating force, is prevented, a charging amount is stable, and a roller contamination caused by excessive external components may be prevented.

An image forming method according to an embodiment of the present invention includes: attaching toner to a surface of a photoreceptor on which an electrostatic latent image is formed so as to form a visible image; and transferring the visible image onto a transfer medium. The toner includes latex, a colorant, and a releasing agent and further includes Si and Fe, each of the Si and Fe is in the range of about 3 to about 1,000 ppm. A mole ratio of Si to Fe (Si/Fe) is in the range of about 0.2 to about 0.8. Also, in a heat absorption curve of the toner measured by a differential scanning calorimeter (DSC), an initiation temperature of a maximum heat absorption peak curve when a temperature increases is in the range of about 68 to about 89° C., and a peak temperature of the maximum heat absorption peak curve is in the range of about 86 to about 89° C. A representative electrophotographic image forming method includes a charging process, an exposing process, a developing process, a transferring process, a fixing process, a cleaning process, and a charge-removing process, in order to form an image on a receptor.

In the charging process, a negative charge or a positive charge is applied to a photoreceptor by corona or a charging roller. In the exposing process, the charged surface of the photoreceptor is selectively discharged to form a latent image using an optical system such as a laser scanner or a diode arrangement. The latent image is formed in an imagewise manner such that the latent image corresponds to a desired image to be formed on a final image receptor. Electromagnetic radiation that may be referred to as "light" may include infrared radiation, visible light radiation, and ultraviolet radiation.

In the developing process, particles of the toner having a sufficient polarity contact the latent image formed on the photoreceptor, and generally, an electrically-biased developer having the same potential polarity to the toner polarity is used. The toner particles move to the photoreceptor and are selectively attached to the latent image by an electrostatic force, and form a toner image on the photoreceptor.

In the transferring process, the toner image is transferred from the photoreceptor to a final image receptor. In some cases, an intermediate transferring element may be used to transfer the toner image from the photoreceptor to the final image receptor.

In the fixing process, the toner image on the final image receptor is heated so that particles of the toner are softened or dissolved and are fixed to the final image receptor. Alternatively, the toner image may be fixed to the final image receptor by heating or by compression at high pressure without heating.

In the cleaning process, residual toner remaining on the photoreceptor is removed.

Finally, in the charge-removing process, the charge of the photoreceptor is exposed to light having a specific wavelength band and is thereby uniformly reduced to a low value. Therefore, the residue of the latent image may be removed and the photoreceptor is made available for a further imaging cycle.

A toner supplying unit according to an embodiment of the present general inventive concept includes: a toner tank storing toner; a supplying part projecting inside the toner tank to discharge the toner from the toner tank; and a toner agitating member rotatably disposed inside the toner tank to agitate the toner in almost an entire inner space of the toner tank, wherein the toner includes Si and Fe, each of the Si and Fe is in the range of about 3 to about 1,000 ppm. A mole ratio of Si to Fe (Si/Fe) is in the range of about 0.1 to about 5. Also, in a heat absorption curve of the toner measured by a differential scanning calorimeter (DSC), an initiation temperature of a maximum heat absorption peak curve when a temperature increases is in the range of about 68 to about 89° C. and a peak temperature of the maximum heat absorption peak curve is in the range of about 86 to about 89° C.

Figure 2:
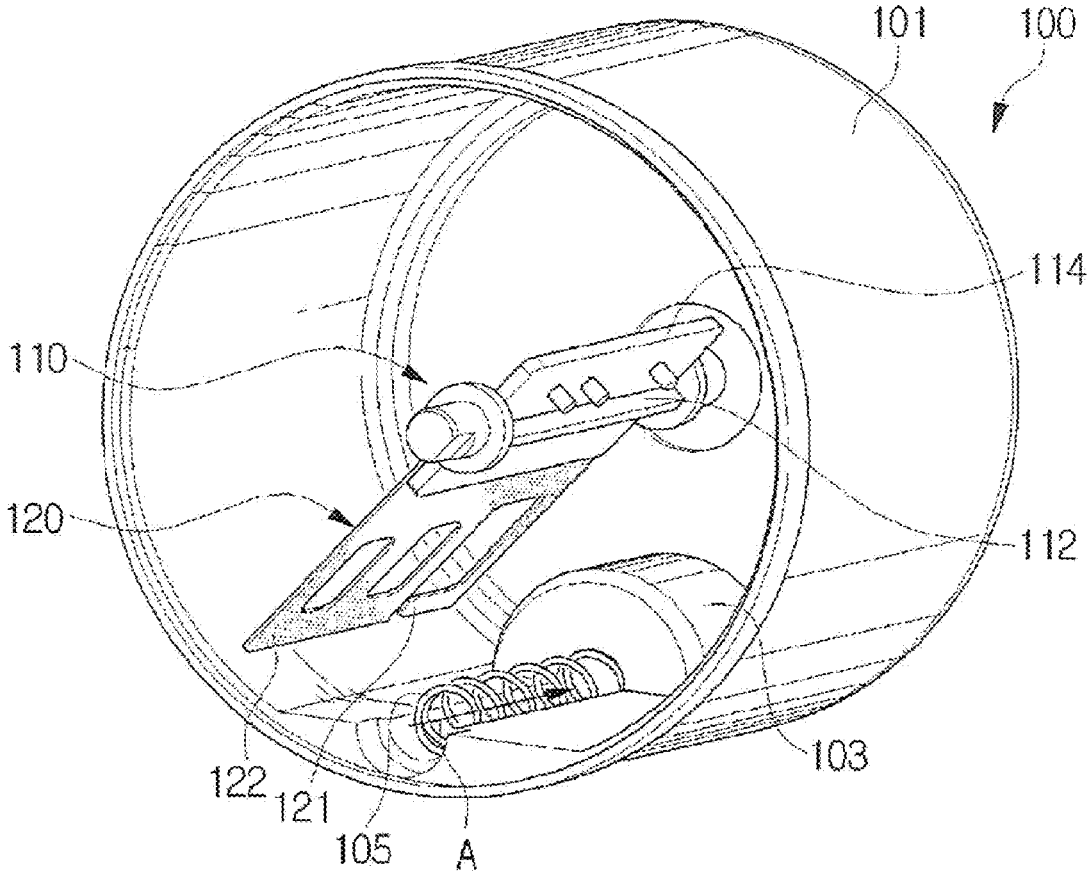
FIG. 2 is a view of a toner supplying unit according to an embodiment of the present general inventive concept.

FIG. 2 is a view of a toner supplying unit 100 according to an embodiment of the present general inventive concept.

The toner supplying unit 100 includes a toner tank 101, a supplying part 103, a toner-conveying member 105, and a toner-agitating member 110.

The toner tank 101 stores a predetermined amount of toner and may be formed in a substantially hollow cylindrical shape.

The supplying part 103 is disposed at an inner bottom of the toner tank 101 and discharges the stored toner from the inside of the toner tank 101 to an outside of the toner tank 101. For example, the supplying part 103 may project from the bottom of the toner tank 101 to the inside of the toner tank 101 in a pillar shape with a semi-circular section. The supplying part 103 includes a toner outlet (not shown) to discharge the toner to an outer surface thereof.

The toner-conveying member 105 is disposed at a side of the supplying part 103 at the inner bottom of the toner tank 101. The toner-conveying member 105 may have, for example, a coil spring shape. An end of the toner-conveying member 105 extends inside the supplying part 103 so that the toner in the toner tank 101 is conveyed into the supplying part 103 as the toner-conveying member 105 rotates. The toner conveyed by the toner-conveying member 105 is discharged to the outside through the toner outlet.

The toner-agitating member 110 is rotatably disposed inside the toner tank 101 and forces the toner in the toner tank 101 to move in a radial direction. That is, when the toner-agitating member 110 rotates at a middle of the toner tank 101, the toner in the toner tank 101 is agitated to prevent the toner from solidifying. As a result, the toner moves down to the bottom of the toner tank 101 due its own weight. The toner-agitating member 110 includes a rotation shaft 112 and a toner-agitating film 120. The rotation shaft 112 is rotatably disposed at the middle of the toner tank 101 and has a driving gear (not shown) coaxially coupled with an end of the rotation shaft 112 projecting from a side of the toner tank 101. Therefore, the rotation of the driving gear causes the rotation shaft 112 to rotate. Also, the rotation shaft 112 may have an wing plate 114 to help fix the toner agitating film 120 to the rotation shaft 112. The wing plate 114 may be formed to be substantially symmetric about the rotation shaft 112. The toner agitating film 120 has a width corresponding to the inner length of the toner tank 101. Furthermore, the toner agitating film 120 may be elastically deformable. For example, the toner agitating film 120 may bend toward or away from a projection inside the toner tank 101, i.e., the supplying part 103.

The toner agitating film 120 may be cut off from an end of the toner agitating film 120 toward the rotation shaft 112 by a predetermined length to form a first agitating part 121 and a second agitating part 122.

An imaging apparatus according to an embodiment of the present general inventive concept includes: an image carrier; an image forming unit that forms an electrostatic latent image on a surface of the image carrier; a unit receiving a toner, a toner supplying unit that supplies the toner onto the surface of the image carrier to develop the electrostatic latent image on the surface of the image carrier into a toner image; and a toner transferring unit that transfers the toner image to a transfer medium from the surface of the image carrier, wherein the toner includes Si and Fe, each of the Si and Fe is in the range of about 3 to about 1,000 ppm. A mole ratio of Si to Fe (Si/Fe) is in the range of about 0.2 to about 0.8. Also, in a heat absorption curve of the toner measured by a differential scanning calorimeter (DSC), an initiation temperature of a maximum heat absorption peak curve when a temperature increases is in the range of about 68 to about 89° C. and a peak temperature of the maximum heat absorption peak curve is in the range of about 86 to about 89° C.

Figure 3:
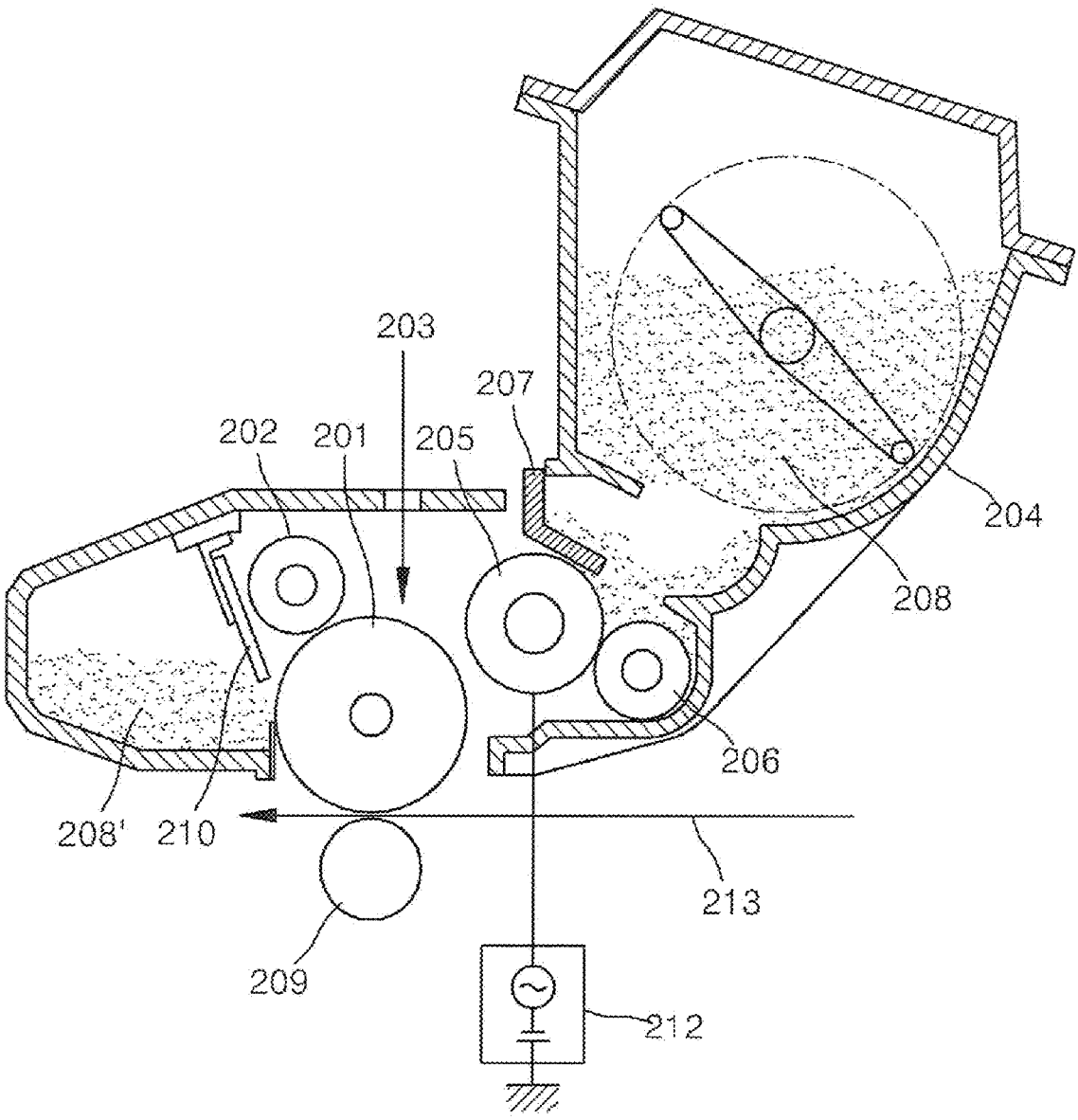
FIG. 3 is a view of an imaging apparatus including toner prepared according to an embodiment of the present general inventive concept.

FIG. 3 is a view of a non-contact development type imaging apparatus including toner prepared using the method described in the previous embodiment, according to an embodiment of the present general inventive concept.

A developer (for example, toner) 208 which includes a nonmagnetic one-component of a developing device 204 is supplied to a developing roller 205 by a supply roller 206 formed of an elastic material, such as polyurethane foam or sponge. The developer 208 supplied to the developing roller 205 reaches a contact portion between a developer controlling blade 207 and the developing roller 205 due to rotation of the developing roller 205. The developer controlling blade 207 may be formed of an elastic material, such as metal or rubber. When the developer 208 passes through the contact portion between the developer controlling blade 207 and the developing roller 205, the developer 208 is controlled and formed into a thin layer which has a uniform thickness and is sufficiently charged. The developer 208 which has been formed into a thin layer is transferred to a development region of a photoreceptor 201 that is an image carrier, in which a latent image is developed by the developing roller 205. At this time, the latent image is formed by scanning light 203 to the photoreceptor 201.

The developing roller 205 is separated from the photoreceptor 201 by a predetermined distance and faces the photoreceptor 201. The developing roller 205 rotates in a counterclockwise direction, and the photoreceptor 201 rotates n clockwise direction.

The developer 208 which has been transferred to the development region of the photoreceptor 201 develops the latent image formed on the photoreceptor 201 by an electric force generated by a potential difference between a direct current (DC) biased alternating current (AC) voltage applied to the developing roller 205 and a latent potential of the photoreceptor 201 charged by a charging unit 202 so as to form a toner image.

The developer 208, which has been transferred to the photoreceptor 201, reaches a transfer unit 209 due to the rotation direction of the photoreceptor 201. The developer 208, which has been transferred to the photoreceptor 201, is transferred to a print medium 213 to form an image by the transfer unit 209 having a roller shape and to which a high voltage having a polarity opposite to the developer 208 is applied, or by corona discharging when the print medium 213 passes between the photoreceptor 201 and the transfer unit 209.

The image transferred to the print medium 213 passes through a high temperature and high pressure fusing device (not shown) and thus the developer 208 is fused to the print medium 213 to form the image. Meanwhile, a non-developed, residual developer 208' on the developing roller 205 is collected by the supply roller 206 to contact the developing roller 205, and the non-developed, residual developer 208' on the photoreceptor 201 is collected by a cleaning blade 210. The processes described above are repeated.

The one or more embodiments will be described in more detail with reference to the examples below, but is not limited thereto. These examples are for illustrative purposes only and are not intended to limit the scope of the one or more embodiments.

Scanning electron microscopic (SEM) images of toners prepared according to the following examples were obtained to identify shapes of the toners. The circularity of the toners may be maintained using an FPIA-3000 apparatus produced by SYSMEX Co., Inc., and using the equation below.

$$\text{Circularity}=2\times(\pi\times\text{area})^{0.5}/\text{circumference}$$

The circularity may be in the range of 0 to 1, and as the circularity approaches 1, the toner particle shape becomes more circular.

Also, a volume diameter of the toner was measured by using a Multisizer III (manufactured by Beckman Coulter Inc.).

Example 1

Synthesis of Primary Latex

A monomer mixture solution (234 g of styrene, 96 g of n-butyl acrylate, 14 g of methacrylic acid, and 6.5 g of polyethylene glycol-ethylethermethacrylate) and 5 g of 1-dodecanethiol acting constituting a chain transfer agent (CTA) were added to a 3 L beaker and the mixture was put in 3% of a HS-10 aqueous solution to emulsify at 75° C. by using a ultrasonic homogenizer. The prepared releasing agent/polymer dispersion was put in a reactor heated to a reaction temperature of 80° C. and 860 g of 3.2% potassium per sulfate aqueous solution, which is a polymerization initiator, was added to the reactor. Then, the reaction was performed for 2 hours under nitrogen current. When the reaction was completed, the monomer mixture solution (145 g of styrene, 66 g of n-butyl acrylate, and 9 g of methacrylic acid) and 3.3 g of 1-dodecanethiol were put in the reactor for 60 minutes by using a starved-feeding method and the reaction was further performed for 6 hours. Then, the reactor was naturally cooled down. After the reaction, the particle size of the primary latex was measured by using a light scattering-type Horiba 910, and the volume average particle diameter measured was about 140 nm.

Preparation of Colorant Dispersion 10 g of a mixture of an anionic reactive emulsifier (HS-10; Dai-ich kogyo, Co., Ltd.) and a non-ionic reactive emulsifier (RN-10; Dai-ich kogyo, Co., Ltd.) in weight ratios shown in Table 2 below and 60 g of a pigment (black, cyan, magenta, and yellow) were added to a milling bath and 400 g of glass beads each having a diameter ranging from 0.8 to 1 mm were added to the milling bath. Then, the mixture was milled at room temperature to prepare a dispersion.

TABLE 2

| color | type of pigment | HS-10:RN-10 (weight ratio) | size |
|---|---|---|---|
| black | Mogul-L | 100:0 | 130 nm |
| | | 80:20 | 120 nm |
| | | 0:100 | 100 nm |
| yellow | PY-84 | 100:0 | 350 nm |
| | | 50:50 | 290 nm |
| | | 0:100 | 280 nm |
| magenta | PR-122 | 100:0 | 320 nm |
| | | 50:50 | 300 nm |
| | | 0:100 | 290 nm |
| cyan | PB 15:4 | 100:0 | 130 nm |
| | | 80:20 | 120 nm |
| | | 80:30 | 120 nm |

Agglomeration and Preparation of Toner 15 g of a nitric acid (0.3 mol) and 15 g of 5% PSI-025 (manufactured by Suido Kiko Co.) were added to a mixture solution, including 500 g of deionized water, 150 g of the primary latex constituting a core, 35 g of 19.5% cyan colorant dispersion (HS-10 100%), and a releasing agent dispersion P-280 (manufactured by Chukyo yushi Co., Ltd) (25-35 weight % of paraffin wax, 5-10 weight % of ester wax, and melting point of 84° C.), in a 1 L reactor, and then the mixture was stirred using a homogenizer at a rate of 11,000 rpm for 6 minutes, thereby obtaining a primary agglomerated toner having a volume average particle diameter of about 1.5 to about 2.5 μm. The resultant mixture solution was added to a 1 L double jacketed reactor and then the temperature was increased by 0.02° C. per minute from room temperature to 50° C. (a temperature equal to or higher than $T_g$−5 degrees of latex). When a volume average particle diameter of the primary agglomerated toner reached about 5.8 μm, 50 g of a secondary latex obtained by polymerizing polystyrene-based polymerizable monomers was added thereto. When the volume average particle diameter of the reaction solution reached 6.0 μm, NaOH (1 mol) was added to the reaction solution to control the pH of the reaction solution to be 7. When the volume average particle diameter was maintained constant for 10 minutes, the temperature was increased to 96° C. at a rate of 0.5° C./min. When the temperature was 96° C., a nitric acid (0.3 mol) was added to the reaction solution to control the pH of the reaction solution to be 6.6. Then, the reaction was performed for 3 to 5 hours to obtain a secondary agglomerated toner having potato-like shaped particles and a particle size of about 5 to about 6 μm. Then, the agglomerated reaction solution was cooled to a temperature lower than $T_g$ and then W a filtering operation was performed to isolate toner particles and the isolated toner particles were dried.

0.5 parts by weight of NX-90 (Nippon Aerosil), 1.0 parts by weight of RX-200 (Nippon Aerosil), and 0.5 parts by weight of SW-100 (Titan Kogyo) were added to 100 parts by weight of the dried toner particles, and then, the mixture was stirred using a mixer (KM-LS2K, Daewha Tech) at a rate of 8,000 rpm for 4 minutes. The resultant toner had a volume average particle diameter 5.8 μm. GSDp and GSDv of the final toner were 1.29 and 1.24, respectively Example 2

Toner was prepared in the same manner as in Example 1, except that P-318 (manufactured by Chukyo yushi Co., Ltd) (30-40 weight % of paraffin wax, 1-5 weight % of ester wax, and melting point of 80° C.) was used as a releasing agent dispersion instead of P-280 (manufactured by Chukyo yushi Co., Ltd). GSDp and GSDv of the toner were 1.28 and 1.21, respectively Example 3

Toner was prepared in the same manner as in Example 1, except that P-419 (manufactured by Chukyo yushi Co., Ltd) (20-30 weight % of paraffin wax, 10-20 weight % of ester wax, and melting point of 88° C.) was used as a releasing agent dispersion instead of P-280 (manufactured by Chukyo yushi Co., Ltd). GSDp and GSDv of the toner were 1.27 and 1.21, respectively.

Example 4

Toner was prepared in the same manner as in Example 1, except that P-420 (manufactured by Chukyo yushi Co., Ltd) (25-35 weight % of paraffin wax, 5-10 weight % of ester wax, and melting point of 89° C.) was used as a releasing agent dispersion instead of P-280 (manufactured by Chukyo yushi Co., Ltd). GSDp and GSDv of the toner were 1.28 and 1.21, respectively.

Comparative Example 1

Toner was prepared in the same manner as in Example 1, except that P-212 (manufactured by Chukyo yushi Co., Ltd) (25-35 weight % of paraffin wax, 5-10 weight % of ester wax, and melting point of 82° C.) was used as a releasing agent dispersion instead of P-280 (manufactured by Chukyo yushi Co., Ltd). GSDp and GSDv of the toner were 1.30 and 1.23, respectively.

Comparative Example 2

Toner was prepared in the same manner as in Example 1, except that paraffin-based wax HNP-100 (manufactured by Chukyo yushi Co., Ltd) (melting point of 90° C.) was used as a releasing agent dispersion instead of P-280 (manufactured by Chukyo yushi Co., Ltd.). GSDp and GSDv of the toner were 1.27 and 1.24, respectively.

Evaluation of Property of Toner

Evaluation of fixing region of toner equipment: Belt-type fusing device non-fixed image for test: 100% pattern test temperature: 100~200° C. (intervals of 10° C.)

fixing speed: 160 mm/sec fixing time: 0.08 sec

This experiment was performed under the conditions described above, and then fixability of the fixed image was evaluated in the following manner.

The OD of the fixed image was measured and then a 3M 810 tape was attached to the fixed image. Then, 500 g of a weight was reciprocated thereon five times and then the tape used was removed. The OD of the fixed image was measured again.

fixability(%)=(after peeling off the *OD*_tape/before peeling off the *OD*_tape)×100.

A fixing temperature region in which the fixability was 90% or more is regarded as a toner fixing region.

MFT: minimum fusing temperature [minimum temperature at which fixability of 90% remains without cold-offset HOT: HOT Offset Temperature [minimum temperature at which hot-offset occurs]

Evaluation of Gloss of Toner

This experiment was performed using a glossmeter at a temperature of 160° C. which is the temperature at which the fixing device was used.

measurement angle: 60° measurement pattern: 100% pattern

Evaluation of High Temperature Preservation Property of Toner

External additives were added to 100 g of a toner. Then the resultant toner was loaded into a developing unit and preserved in a constant-temperature and constant-humidity oven under the following conditions while being packaged.

23° C., 55% RH (Relative Humidity) 2 hr

=>40° C., 90% RH 48 hr

=>50° C., 80% RH 48 hr

=>40° C., 90% RH 48 hr

=>23° C., 55% RH 6 hr

After preserved under the conditions described above, it was identified with the naked eye whether toner caking occurred in the developing unit, and a 100% image was output to evaluate image defects.

Evaluation Standard

○: fine image, no-caking

Δ: poor image, no-caking

X: caking occurred

Toner Agglomeration Evaluation (Carr's Cohesion)

Equipment: Hosokawa micron powder tester PT-S sample amount: 2 g (toner that contains external additives, or toner that does not contain external additives)

Amplitude: 1 mm_dial 3~3.5

Sieve: 53, 45, 38 um

Oscillation Time:

After the sieves were placed at a temperature of 23° C. in RH 55% for 2 hours, the amount of toner in the respective sieves was measured before and after this experiment was performed under the conditions described above.

(1) [(quantity of particles remaining in the largest sieve)/2 g]×100

(2) [(quantity of particles remaining in middle-sized sieve)/2 g]×100×(3/5)

(3) [(quantity of particles remaining in the smallest sieve)/2 g]×100×(1/5)

Carr's Cohesion=(1)+(2)+(3)

Evaluation Standard

◎: 10% or below

○: 20% or below

Δ: 50% or below

X: 50% or above

Evaluation of Charging Characteristics of Toner 28.5 g of a carrier (SS82, powdertech) and 1.5 g of toner were added to 60 ml of a glass container and then the mixture was stirred using a turbula mixer. The amount of toner charged was measured by an electric field separation method.

Toner charging stability with respect to a mixing hour at room temperature and room humidity and the amount of toner charged at high-temperature and high-humidity/the amount of toner charged at low-temperature and low-humidity ratio (HH/LL) were used for evaluation.

room temperature and room humidity: 23° C., RH 55% high-temperature and high-humidity: 32° C., RH 80% low-temperature and low-humidity: 10° C., RH 10%

Evaluation Standard

○: 0.59≦HH/LL ratio≦0.65

Δ: 0.45≦HH/LL ratio<0.59

X: HH/LL ratio<0.45

The evaluations described above were performed on each of the toners prepared according to Examples 1 through 4 and Comparative Examples 1 through 2. The results are shown in Table 3.

According to the present general inventive concept, a releasing agent, which is harmless to a human body and an environment and in which compatibility with latex of toner is differentiated, is used to prepare the electrophotographic toner having a high gloss image and a wide fixing region.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An electrophotographic toner comprising a latex, a colorant, and a releasing agent, wherein the electrophotographic toner comprises silicon (Si) and iron (Fe), each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases in a heat absorption curve of the toner measured by a differential scanning calorimeter (DSC) is in the range of about 68 to about 89° C., and a peak temperature of the maximum heat absorption peak curve is in the range of about 86 to about 89° C., and wherein the releasing agent comprises 100 parts by weight of a paraffin-based wax and about 12.5 to about 50 parts by weight of an ester-based wax.

TABLE 3

| | Releasing agent | $T_g$ [latex] [° C.] | $T_g$ [toner] [° C.] | $\delta T_g$ [° C.] | $T_m$[toner] Initiation temperature [° C.] | $T_m$[toner] peak temperature [° C.] | Temperature [η = 1*10⁴ Pa · s] [° C.] | gloss | fixing region MFT [° C.] | fixing region HOT [° C.] | Charging characteristics HH/LL | | Flowability | high temperature preservation property |
|---|---|---|---|---|---|---|---|---|---|---|---|---|---|---|
| Example 1 | P-280 | 66.6 | 55.1 | 11.5 | 68.2 | 89.9 | 106 | 8.4 | 140 | 210 | 0.65 | ○ | ○ | ○ |
| Example 2 | P-318 | 68.0 | 59.5 | 8.5 | 82.1 | 86.8 | 108 | 8.1 | 140 | 210 | 0.59 | ○ | ○ | ○ |
| Example 3 | P-419 | 67.0 | 60.1 | 6.9 | 88.5 | 88.1 | 109 | 8.8 | 150 | 210 | 0.63 | ○ | ○ | ○ |
| Example 4 | P-420 | 67.0 | 60.6 | 6.4 | 89.1 | 89.0 | 111 | 8.8 | 150 | 210 | 0.62 | ○ | ○ | ○ |
| Comparative Example 1 | P-212 | 66.6 | 54.1 | 12.5 | 68.0 | 80.4 | 95 | 8.9 | 130 | 200 | 0.41 | X | Δ | X |
| Comparative Example 2 | HNP-100 | 67.0 | 62.5 | 4.5 | 80.2 | 90.8 | 125 | 5.8 | 180 | 210 | 0.48 | Δ | ○ | ○ |

* δTg = latex Tg − toner Tg

In Table 3, δTg denotes a difference between Tg of latex and Tg of toner. As compatibility of releasing agent and the latex reduces, releasing agent is less plasticized and thus the difference between Tg of latex and Tg of toner reduces.

Referring to Table 3, if δTg, which represent compatibility of toner resin and a releasing agent as in the toners prepared in Examples 1 through 4, is in the range of 6.4 to 11.5° C., properties of the toner are excellent. However, in Comparative Example 1 where δTg is greater than 12.0° C., charging characteristic is unstable, high temperature preservation characteristics are deteriorated, and agglomeration increases. This is because compatibility of the releasing agent and the toner excessively increases and the releasing agent may be projected from the surface of the toner.

In addition, in Comparative Example 2 where δTg is less than 6.4° C., agglomeration of the toner decreases so that a high temperature preservation characteristic improves and the fixing region is minutely reduced.

2. The electrophotographic toner of claim 1, wherein a difference between Tg of the latex and Tg of the toner is in the range of about 6.4 to about 12.0° C.

3. The electrophotographic toner of claim 1, wherein an volume average particle diameter of the electrophotographic toner is in the range of about 3 to about 8 μm.

4. The electrophotographic toner of claim 1, wherein an average circularity of the electrophotographic toner is in the range of about 0.940 to about 0.980.

5. The electrophotographic toner of claim 1, wherein an average circularity difference of the toner in which an average particle diameter is in the range of about 2 to 5 μm, is about 0.020 or below.

6. The electrophotographic toner of claim 1, wherein a volume average particle size distribution index (GBDv) of the electrophotographic toner and a number average particle size distribution index (GSDp) of the electrophotographic toner is about 1.25 or less.

7. The electrophotographic toner of claim 1, wherein, in the releasing agent, an initiation temperature of a maximum heat absorption peak curve when a temperature increases in a heat absorption curve measured by the DSC is in a range of about 68 to about 75° C., and a peak temperature of the maximum heat absorption peak curve is in a range of about 77 to about 85° C.

8. The electrophotographic toner of claim 1, wherein an amount of the releasing agent is in a range of about 1 to about 20 parts by weight, about 2 to about 16 parts by weight, or about 3 to about 12 parts by weight, based on 100 parts by weight of the toner.

9. A method of preparing an electrophotographic toner comprising:

preparing a mixture solution of a primary latex, a colorant dispersion, and a release agent dispersion;

preparing a primary agglomerated toner by adding an agglomerating agent to the mixture solution; and preparing a secondary agglomerated toner by coating the primary agglomerated toner with a secondary latex prepared by polymerizing at least one polymerizable monomer, wherein the electrophotographic toner comprises Si and Fe, each of the Si and Fe is in the range of about 3 to about 1,000 ppm, a mole ratio of Si to Fe (Si/Fe) is in the range of about 0.1 to about 5, an initiation temperature of a maximum heat absorption peak curve when a temperature increases in a heat absorption curve of the toner measured by a differential scanning calorimeter (DSC) is in the range of about 68 to about 89° C., and a peak temperature of the maximum heat absorption peak curve is in the range of about 86 to about 89° C., and wherein the releasing agent comprises 100 parts by weight of a paraffin-based wax and about 12.5 to about 50 parts by weight of an ester-based wax.

10. The method of claim 9, wherein the primary latex comprises: polyester; a polymer obtained by polymerizing at least one polymerizable monomer; or a mixture thereof.

11. The method of claim 9, further comprising coating a tertiary latex prepared by polymerizing at least one polymerizable monomer on the secondary agglomerated toner.

12. The method of claim 9, wherein the at least one polymerizable monomer comprises: at least one selected from the group consisting of styrene-based monomers; acrylic acids; methacrylic acid; derivatives of (meth)acrylic acids; ethylenically unsaturated mono-olefins; halogenated vinyls; vinyl esters; vinyl ketones; and nitrogen-containing vinyl compounds.

13. The method of claim 9, wherein the releasing agent dispersion comprises an ester group.

14. The method of claim 9, wherein the releasing agent dispersion comprises:

an ester group-containing paraffin-based wax.

15. The method of claim 9, wherein the agglomerating agent comprises a Si and Fe-containing metal salt.

16. The method of claim 9, wherein the agglomerating agent comprises polysilicate iron.

* * * * *